US008695381B2

(12) United States Patent
Moore

(10) Patent No.: US 8,695,381 B2
(45) Date of Patent: Apr. 15, 2014

(54) LAUNDERING DEVICE VIBRATION CONTROL

(75) Inventor: Michael T. Moore, Webster City, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 1025 days.

(21) Appl. No.: 12/057,777

(22) Filed: Mar. 28, 2008

(65) Prior Publication Data

US 2009/0241605 A1 Oct. 1, 2009

(51) Int. Cl.
*D06F 33/00* (2006.01)

(52) U.S. Cl.
USPC ..... 68/12.06; 68/12.14; 8/158; 8/159

(58) Field of Classification Search
USPC ..... 8/159, 158; 68/12.06, 12.14
See application file for complete search history.

(56) References Cited

U.S. PATENT DOCUMENTS

| | | | | |
|---|---|---|---|---|
| 3,446,043 | A | 5/1969 | Severance | |
| 3,674,419 | A | 7/1972 | Tichy | |
| 4,411,664 | A | 10/1983 | Rickard et al. | |
| 4,513,464 | A * | 4/1985 | Rettich et al. | 8/159 |
| 4,782,544 | A * | 11/1988 | Nystuen et al. | 8/159 |
| 5,085,064 | A | 2/1992 | Hayashi et al. | |
| 5,280,660 | A | 1/1994 | Pellerin et al. | |
| 5,301,522 | A | 4/1994 | Izkemizu et al. | |
| 5,561,990 | A | 10/1996 | Berkcan et al. | |
| 5,685,038 | A | 11/1997 | Smith et al. | |
| 5,720,066 | A * | 2/1998 | Kim | 8/159 |
| 5,768,730 | A | 6/1998 | Matsumoto et al. | |
| 5,839,297 | A | 11/1998 | Swint | |
| 5,862,553 | A | 1/1999 | Haberl et al. | |
| 5,893,279 | A | 4/1999 | Schantz et al. | |
| 5,906,020 | A | 5/1999 | Swint | |

(Continued)

FOREIGN PATENT DOCUMENTS

| | | |
|---|---|---|
| CN | 1661156 A | 8/2005 |
| EP | 1087052 | 3/2001 |

(Continued)

OTHER PUBLICATIONS

Sep. 28, 2010 International Preliminary Report on Patentability issued in corresponding PCT/US2009/038168.

(Continued)

*Primary Examiner* — Michael Kornakov
*Assistant Examiner* — Katelyn Whatley
(74) *Attorney, Agent, or Firm* — Banner & Witcoff, Ltd.

(57) ABSTRACT

Methods and systems that detect high resonance frequencies as a laundering device (e.g., a washer or dryer) is in a spin cycle, and avoids those frequencies, as well as a band around those frequencies (e.g., 75 rpm on either side of the resonant frequency), in subsequent spin cycles, is described. Aspects of the invention also provide for detecting whether the setup of the laundering device has changed (e.g., resulting from a change in physical location or setup), and provides for the recalibration of a resonance frequency or known high vibration speed when a new setup is detected. Aspects of the invention recognize that solutions to minimize vibration are unnecessary. It is not necessary to optimize or minimize vibration in order for a laundry device to work properly, but rather it is sufficient to ensure that the laundry device does not spin the drum at a speed that causes excessive vibration.

17 Claims, 3 Drawing Sheets

(56) References Cited

U.S. PATENT DOCUMENTS

| | | | | |
|---|---|---|---|---|
| 5,924,312 | A * | 7/1999 | Vande Haar | 68/23.2 |
| 5,930,855 | A * | 8/1999 | Vande Haar et al. | 8/159 |
| 5,970,555 | A | 10/1999 | Baek et al. | |
| 6,032,494 | A * | 3/2000 | Tanigawa et al. | 68/12.06 |
| 6,047,428 | A * | 4/2000 | Min | 8/159 |
| 6,065,170 | A | 5/2000 | Jang | |
| 6,087,951 | A | 7/2000 | Ramsden et al. | |
| 6,134,926 | A * | 10/2000 | Vande Haar et al. | 68/12.06 |
| 6,151,930 | A | 11/2000 | Carlson | |
| 6,158,072 | A | 12/2000 | Baek et al. | |
| 6,292,966 | B1 | 9/2001 | Lim et al. | |
| 6,422,047 | B1 | 7/2002 | Magilton | |
| 6,477,867 | B1 | 11/2002 | Collecutt et al. | |
| 6,510,715 | B1 | 1/2003 | Simsek | |
| 6,530,100 | B2 * | 3/2003 | Conrath | 8/159 |
| 6,546,354 | B1 * | 4/2003 | Gayme | 702/147 |
| 6,564,592 | B2 | 5/2003 | Bruce et al. | |
| 6,591,439 | B2 | 7/2003 | Whah et al. | |
| 6,640,637 | B2 | 11/2003 | Baek | |
| 6,647,575 | B2 | 11/2003 | Garstecki et al. | |
| 6,654,975 | B2 | 12/2003 | Broker | |
| 6,832,519 | B2 | 12/2004 | Baek | |
| 6,865,947 | B2 | 3/2005 | Baek | |
| 7,059,003 | B2 | 6/2006 | Bergemann et al. | |
| 7,191,484 | B2 * | 3/2007 | Dawe | 8/158 |
| 7,581,272 | B2 * | 9/2009 | Xie et al. | 8/159 |
| 7,673,358 | B2 * | 3/2010 | Dietz et al. | 8/158 |
| 7,707,671 | B2 * | 5/2010 | Koo | 8/158 |
| 7,752,694 | B2 * | 7/2010 | Koo | 8/159 |
| 2003/0029205 | A1 * | 2/2003 | Dawe | 68/12.06 |
| 2003/0037383 | A1 | 2/2003 | Broker | |
| 2003/0140427 | A1 | 7/2003 | Yamamoto et al. | |
| 2004/0098813 | A1 | 5/2004 | Son | |
| 2004/0148973 | A1 | 8/2004 | No et al. | |
| 2004/0154351 | A1 | 8/2004 | Kim et al. | |
| 2004/0168480 | A1 | 9/2004 | Lorenz et al. | |
| 2005/0066450 | A1 | 3/2005 | Weinmann | |
| 2005/0102765 | A1 | 5/2005 | Jeong et al. | |
| 2005/0188473 | A1 * | 9/2005 | Son et al. | 8/159 |
| 2005/0204482 | A1 | 9/2005 | Murray et al. | |
| 2005/0268670 | A1 | 12/2005 | Hirasawa et al. | |
| 2006/0010936 | A1 | 1/2006 | Weinmann et al. | |
| 2006/0053839 | A1 | 3/2006 | Matsushima et al. | |
| 2006/0130533 | A1 | 6/2006 | Ooe et al. | |
| 2006/0185097 | A1 | 8/2006 | Weinmann et al. | |
| 2006/0185403 | A1 | 8/2006 | Ikemizu et al. | |
| 2006/0191337 | A1 | 8/2006 | Marioni | |
| 2006/0242769 | A1 | 11/2006 | Borras et al. | |
| 2007/0006619 | A1 | 1/2007 | Schenkl et al. | |
| 2007/0017037 | A1 | 1/2007 | Son | |
| 2007/0039104 | A1 | 2/2007 | Lee et al. | |
| 2007/0039105 | A1 | 2/2007 | Lee et al. | |
| 2007/0044247 | A1 | 3/2007 | Park et al. | |
| 2007/0050918 | A1 | 3/2007 | Kim et al. | |
| 2007/0050919 | A1 | 3/2007 | Koo | |
| 2007/0050920 | A1 | 3/2007 | Koo | |
| 2007/0101511 | A1 | 5/2007 | Park et al. | |
| 2007/0283726 | A1 * | 12/2007 | Lee et al. | 68/12.06 |
| 2007/0294838 | A1 * | 12/2007 | Croxton | 8/158 |
| 2009/0165218 | A1 | 7/2009 | Son et al. | |
| 2009/0249560 | A1 * | 10/2009 | Gaulter et al. | 8/158 |
| 2009/0300851 | A1 * | 12/2009 | Bae et al. | 8/159 |
| 2009/0307851 | A1 * | 12/2009 | Bae et al. | 8/159 |
| 2010/0236295 | A1 * | 9/2010 | Volpato et al. | 68/12.06 |
| 2012/0278996 | A1 * | 11/2012 | Park et al. | 8/137 |

FOREIGN PATENT DOCUMENTS

| | | | | |
|---|---|---|---|---|
| EP | 1 362 946 | | 11/2003 | |
| EP | 1 568 813 | | 8/2005 | |
| EP | 1568813 | A1 * | 8/2005 | D06F 37/20 |
| EP | 1 882 770 | | 1/2008 | |
| EP | 1882770 | A1 * | 1/2008 | D06F 37/20 |
| GB | 2073257 | | 10/1981 | |
| GB | 2141232 | | 12/1984 | |

OTHER PUBLICATIONS

Janssens, Poos, Warmoeskerken, Parry, van der Mark, Nieuwkoop, Renes, de Vreede, Prak, Wehrmeijer, Wissink, Brunink, Leeuwis and van Mierlo, "Columbus: A Novel Sensor System for Domestic Washing Machines", Sensors, Jun. 2002, 10 pages.

Christophe Lemaire, "Detecting Out-of-Balance Conditions with MEMS Technology", Sensors, Aug. 2003, 6 pages.

International Search Report and Written Opinion of the International Searching Authority, mailed Nov. 30, 2009 in corresponding International Application No. PCT/US2009/038168.

Invitation to Pay Additional Fees and, Where Applicable, Protest Fees, mailed Jul. 8, 2009 in corresponding International Application No. PCT/US2009/038168.

Notification of the First Office Action for Chinese patent application No. 200980113132.2 mailed Apr. 6, 2012.

The Third Office Action and Search Report for Chinese patent application No. 200980113132.2 dated Jul. 3, 2013.

The Second Office Action for Chinese patent application No. 200980113132.2 dated Dec. 31, 2012.

* cited by examiner

LAUNDERING DEVICE VIBRATION CONTROL

FIELD OF THE INVENTION

The invention relates generally to clothes laundering appliances, e.g., clothes washers and dryers. More specifically, the invention provides a method and system for avoiding maximum vibration levels during spin cycles in a laundering appliance, and also for detecting when the installation of a laundering appliance has changed and vibration levels need to be recalibrated.

BACKGROUND OF THE INVENTION

Laundry devices, both washers and dryers, typically include a generally circular drum that is used to house the articles being washed and/or dried in the device. The drum is generally spun, sometimes at very high speeds, to wash, agitate, rinse, and even dry articles in the device. When the drum is spinning at high speeds, the drum may cause vibration within the device, e.g., when the drum is spinning at a speed that generates a resonant frequency of the device. High vibration can impede the effectiveness of the laundry device, and in extreme cases even cause damage to the laundry device.

Previous solutions include attempting to minimize vibration in order to minimize the impact of vibration on the laundry device. For example, U.S. Pat. No. 5,930,855 describes a method and system for optimizing the rotational speed of a washing machine tub (drum) to minimize washing machine vibration. However, such solutions use excessive resources to find an optimal rotational speed in order to minimize machine vibration.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

To overcome limitations in the prior art described above, and to overcome other limitations that will be apparent upon reading and understanding the present specification, aspects of the present invention is directed to a method and system that detects high resonance frequencies as a washing machine or other laundering device is in a spin cycle, and avoids those frequencies, as well as a band around those frequencies (e.g., 75 rpm on either side of the resonant frequency), in subsequent spin cycles. Aspects of the invention also provide a method and system for detecting whether the setup of the washing machine has changed (e.g., resulting from movement from one installation location to another), and allows for the recalibration of resonance frequencies when a new setup is detected.

Aspects of the present invention are grounded in the realization by the inventors that schemes to minimize vibration are unnecessary insofar as it is not necessary to optimize or minimize vibration in order for a laundry device to work properly, but rather it is sufficient to ensure that the laundry device does not spin the drum at a speed that causes excessive vibration. I.e., some vibration is acceptable, and processor resources can be minimized, thereby lessening expense, by using vibration avoidance as described herein, rather than the vibration minimization techniques of the prior art.

A first aspect of the invention provides a laundry appliance that avoids high vibration levels. The laundry appliance may include a processor controlling one or more operations of the appliance, and memory storing computer readable instructions that, when executed by the processor, configure the appliance to avoid a high vibration level. The laundry appliance avoids the high vibration level by identifying a harmonic speed during the first spin cycle at which time the maximum vibration level is detected. When a set spin speed for a subsequent cycle is within a predefined range of the harmonic speed, the laundry appliance adjusts the spin speed to be outside the predefined range of the harmonic speed. The laundry appliance then completes the subsequent spin cycle based on the adjusted spin speed. A complementary method is also described.

A second aspect of the invention provides a laundry appliance that recalibrates a known high vibration speed (which can be used for vibration avoidance as described herein) when it detects that the harmonic speed or installation of the appliance has changed. The laundering appliance may include a drum container for receiving one or more articles to be laundered in the laundering appliance, a motor connected to the drum so that when the motor is actuated the motor spins the drum, a controller that sends commands to the motor to controllably spin the drum during a spin cycle at one or more speeds specified by the controller, and memory storing computer readable instructions that, when executed by the controller, configure the laundering appliance to recalibrate a vibration setting. In one embodiment, the laundering appliance determines a machine harmonic speed of the laundering appliance during a first spin cycle. Upon detecting that a cycle harmonic speed for each of a plurality of consecutive spin cycles subsequent to the first spin cycle is different than the machine harmonic speed, and further upon detecting that the cycle harmonic speed for each of the plurality of consecutive spin cycles, beginning with the second spin cycle in the plurality of consecutive spin cycles, is within a predetermined range of the cycle harmonic speed for the first spin cycle of the plurality of consecutive spin cycles, the laundering appliance adjusts the machine harmonic speed to be the same as the cycle harmonic speed of the first spin cycle of the plurality of consecutive spin cycles. A complementary method is also described.

These and other aspects of the invention will be readily understood upon reading the detailed description below in view the accompanying drawings.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
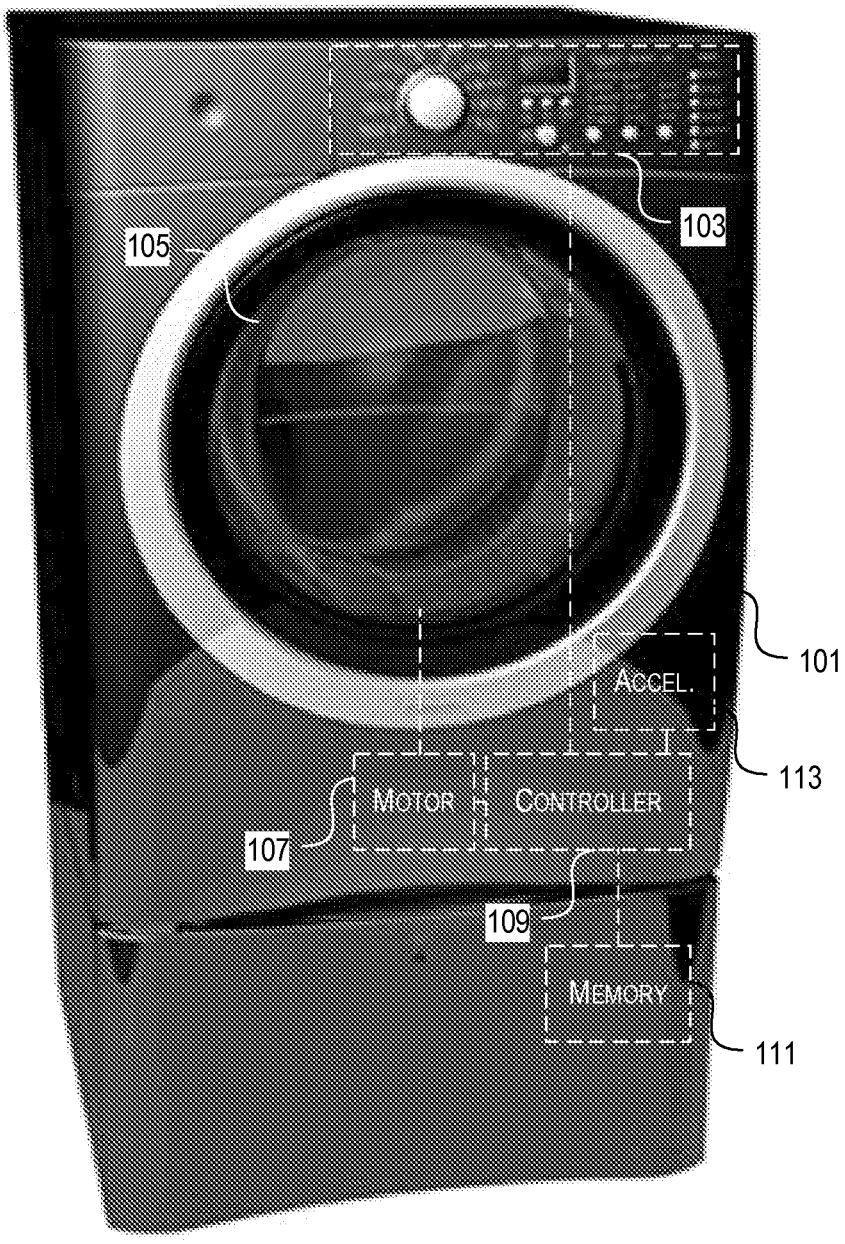
FIG. 1 illustrates a schematic diagram of a laundry device that incorporates one or more illustrative aspects of the invention.

As indicated above, and with reference to FIG. 1, aspects of the invention provide a method and system that detects high resonance frequencies of a washing machine 101 or other laundering device during a spin cycle. The washing machine 101 subsequently avoids the high vibration frequency, as well as a band around that frequency (e.g., 75 rpm on either side of the resonant frequency), in later spin cycles. Aspects of the invention also provide a method and system for detecting whether the setup of the washing machine 101 has changed (e.g., resulting from movement from one installation location to another), and allows for the recalibration of resonance frequencies when a new setup is detected. While a washing machine is used throughout this description for illustrative purposes, the principles described herein apply equally well and are intended to cover other types of appliances that include a spinning drum.

Washing machine 101 may include a user interface panel 103 that provides one or more controls through which a user can control the laundering device. For example, on a washing machine, such as washing machine 101, the controls may include one or more dials, buttons, display screens, indicator lights, and the like, through which a user can select a load size (e.g., small, medium, large, etc.), load type (e.g., delicates, cotton, permanent press, etc.), pre-wash parameters (e.g., none, short soak, long soak, etc.), fabric softener parameters, and any other cycle variable selectable by the user.

Washing machine further includes a drum 105 that spins based on input received from motor 107. Motor 107 may be any type of motor capable of spinning drum 105 while drum 105 is full or partially full of clothes (or other items intended for use with the applicable appliance), and may include an electric, mechanical, electromechanical, and/or magnetically driven motor. Motor 107 is controlled by CPU/Controller 109, which controls overall operation of the washing machine 101. Controller 109 may read and process instructions from a memory 111, e.g., stored as computer readable instructions in software, hardware, firmware, etc. That is, one or more aspects of the invention may be embodied in computer-usable data and computer-executable instructions, such as in one or more program modules, executed by one or more computers or other devices. Generally, program modules include routines, programs, objects, components, data structures, etc. that perform particular tasks or implement particular abstract data types when executed by a processor in a computer or other device. The computer executable instructions may be stored on a computer readable medium such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the invention, and such data structures are contemplated within the scope of computer executable instructions and computer-usable data described herein.

Washing machine 101 may further include an accelerometer 113 to detect vibration of the washing machine during operation. Alternatively, any sensor that detects and/or senses vibration may be used. The output of the accelerometer 113 is usable by the controller 109 based on the instructions read from memory 111. Washing machine 101 may of course include other parts and subsystems, such as soap dispensers, water level controls, etc. However, such features are not relevant to the scope of the present invention, and need not be discussed further herein.

Figure 2:
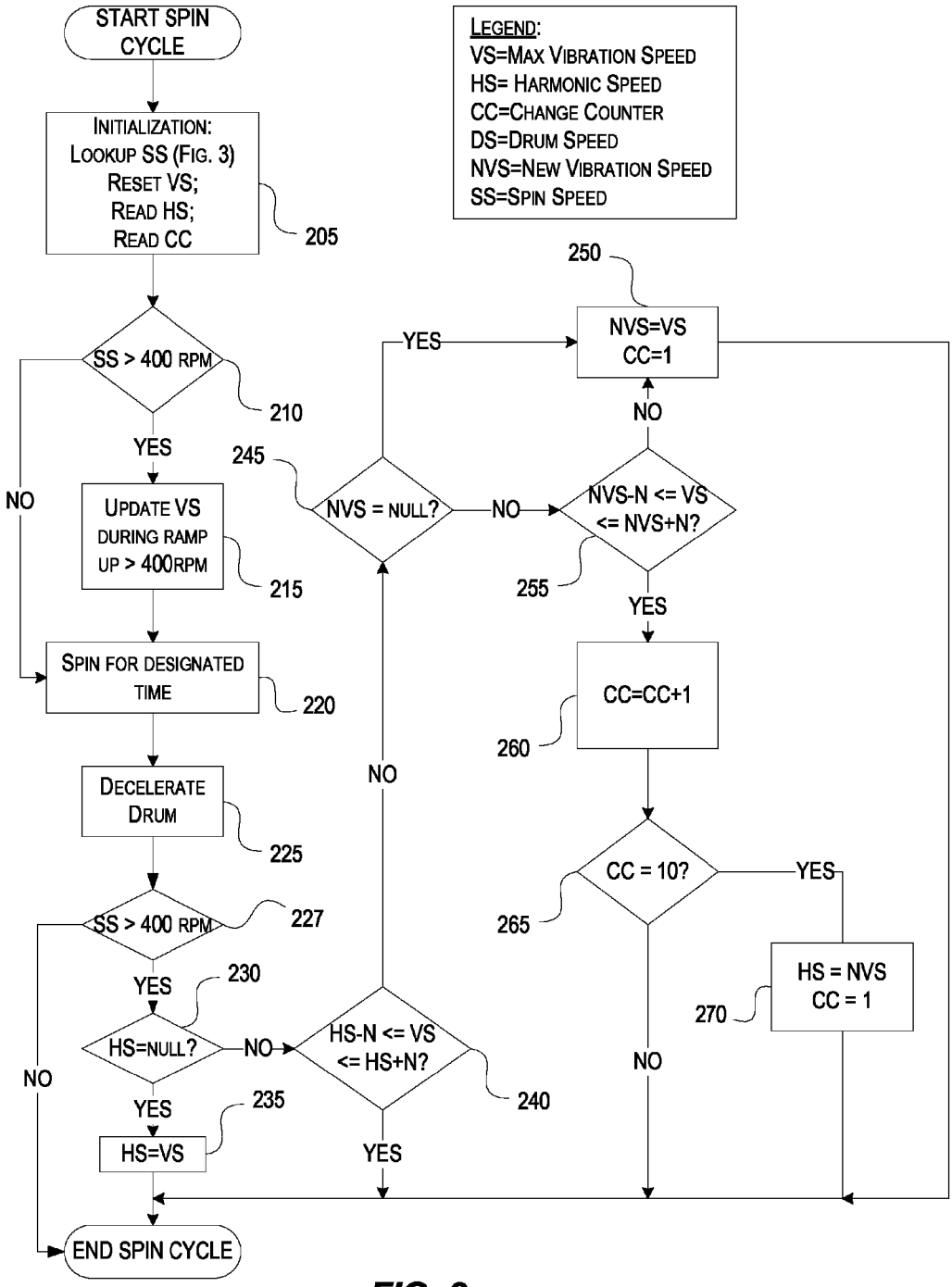
FIG. 2 illustrates a method for determining a high vibration level and recalibrating the high vibration level based on detecting a new high vibration level, according to one or more illustrative aspects of the invention.

FIG. 2 illustrates a method for determining a high resonance frequency while a laundering appliance drum is in a spin cycle, e.g., drum 105 of washing machine 101. The terms high resonance frequency, high vibration level, and harmonic speed are used interchangeably herein, and refer to a state of the washing machine during which machine vibration is at a maximum, which typically occurs at a resonance frequency of the washing machine. In addition, the following methodology is described with respect to the washing machine 101 performing certain actions. It should be understood that the washing machine is operating under the control of controller 109, and that in fact it may be controller 109 that is taking some action or causing the washing machine to operate in the recited manner.

As used in FIG. 2, VS represents a Max Vibration Speed during the current cycle; HS represents the known Harmonic Speed of the washing machine; CC represents a counter to identify when an installation setup of the washing machine has changed; DS represents a current drum speed; NVS represents a New Vibration Speed when the washing machine detects that the highest vibration during a spin did not occur at the harmonic speed; and SS represents the intended Spin Speed for the spin cycle, as determined by controller 109.

Initially, in step 205, washing machine 101 initializes relevant variable(s) for a new spin cycle, including SS, VS, HS, and CC. That is, the washing machine looks up the intended or desired spin speed based on the cycle variables for the present load of laundry, using the methodology described in FIG. 3 (described below). Cycle variables (e.g., load size, type, etc.) may be received as user input via the control panel 103, or may be detected or determined automatically by one or more sensors or algorithms in the washing machine 101. Washing machine 101 resets the max vibration speed VS prior to starting the new spin cycle, because the variable VS will be used to monitor the speed at which the highest vibration is reached during the present spin cycle. Washing machine 101 reads and/or stores the known harmonic speed HS for future reference, as well as the change counter variable CC.

In step 210 the washing machine 101 determines whether the intended spin speed is greater than a threshold level below which the washing machine ignores machine vibration. In this example, the threshold level is 400 RPM. That is, when washing machine 101 is spinning the drum 105 below 400 RPM, washing machine 101 does not track machine vibration because vibration is generally known to not cause problems when the drum speed is below the threshold level.

When SS is above the threshold level, in step 215 the washing machine accelerates the drum 105 to the desired speed, and periodically reads or receives data from accelerometer 113 to determine the speed at which vibration is at a maximum during the spin cycle. Washing machine 101 stores the speed at which vibration is at a maximum during the spin cycle, along with the vibration level detected by the accelerometer, in the VS variable or data structure. In step 220 the washing machine 101 spins the drum 105 for the designated amount of time, as determined by the controller 109 based on the cycle variables. At the end of the spin cycle, washing machine 101 decelerates the drum 105 in step 225. As determined in step 230, if the spin speed was below the threshold level (here, 400 RPM), the method ends, because the washing machine does not track or update the harmonic speed based on vibration detected below 400 RPM.

When the spin speed was above the threshold level, washing machine 101 proceeds to steps 230-270 to determine whether the installation of the washing machine has changed, and if so, also determine whether the known harmonic speed should be changed. In step 230, washing machine 101 determines whether harmonic speed HS is null, i.e., the washing machine is new, has never been run in a consumer environment, and/or has been reset to factory default settings. That is, part of the initialization procedures for the user, installer or technician might include resetting the harmonic speed variable. HS may be set to null during routine maintenance or on command by a user. Regardless of why HS is null, when HS is null the harmonic speed HS is set to equal the max vibration speed VS, and the method ends.

Alternatively, when the harmonic speed HS has been previously set, the washing machine compares the max vibration speed VS for the just finished spin cycle and compares it to the harmonic speed in step 240. In step 240, washing machine 101 determines whether the most recently detected maximum vibration speed VS was within a predetermined range of the known harmonic speed, e.g., within 50 RPM of the harmonic speed HS. The predetermined range is used to create a "slop zone" around the harmonic speed because the harmonic speed might actually vary slightly from cycle to cycle, whereas the harmonic speed typically does not vary substantially unless the installation of the washing machine has changed, e.g., as a result of being moved from a concrete floor basement to a wood sub-floor upper level of a home. However, even if the harmonic speed anomalously varies beyond the predetermined range during an isolated cycle, the Change Counter variable must still reach a predetermined level before the harmonic speed will be changed, as further discussed below.

If the max vibration speed VS for the just finished cycle is within the predetermined range of the harmonic speed HS, as determined in step 240, then the method ends without any changes to the harmonic speed HS or change counter CC. However, if the max vibration speed VS is not within the predetermined range of the harmonic speed HS, then washing machine 101 in step 245 checks to determine whether the New Vibration Speed NVS variable is null, i.e., whether this is the first time the washing machine has detected a high vibration speed at other than the harmonic speed HS. If NVS is null, then washing machine 101 in step 250 sets NVS equal to the max vibration speed detected during the just finished spin cycle, resets the change counter to 1, and ends.

If the new vibration speed NVS is not null, i.e., the washing machine has previously detected a speed that reaches the highest vibration during a spin cycle at other than the harmonic speed HS, then washing machine 101 in step 255 determines whether max vibration speed VS is within a predetermined range, e.g., within 50 RPM, of the new vibration speed NVS. The predetermined range is used for similar reasons as with the max vibration speed VS being compared against the harmonic speed HS in step 240, namely, because the max vibration speed VS may vary slightly from cycle to cycle, but it should not change substantially unless the machine installation or setup has changed.

If the max vibration speed VS is not within the predetermined range of the previously known new vibration speed NVS, then the method reverts to step 250 where the new vibration speed NVS is set to equal max vibration speed VS, change counter CC is reset to one (1), and the method ends. If the max vibration speed VS is within the predetermined range of new vibration speed NVS, as determined in step 255, then in step 260 washing machine 101 increments change counter by one. That is, change counter CC represents the number of consecutive cycles during which the washing machine has detected a relatively constant new vibration speed, i.e., speeds all within the predetermined range.

In step 265 washing machine determines whether change counter CC is at least 10, i.e., for nine (9) spin cycles in a row washing machine 101 has detected that the maximum vibration occurs at a speed other than the harmonic speed, and that other speed has remained constant (or at least within a predefined range of itself). When the conditions of step 265 are met, then in step 270 the washing machine 101 sets the harmonic speed HS based on the new vibration speed NVS, and resets change counter CC. The method then ends the spin cycle procedure. If in step 265 the change counter has not reached ten (10), then the method also ends the spin cycle procedure.

The methodology of FIG. 2 is intended to represent one possible embodiment for monitoring and altering a maximum vibration speed, harmonic speed, or resonant frequency of a washing machine and other methods may alternatively be used. One or more steps in FIG. 2 may be optional, and steps may be performed in other than their recited order. Functions in each step may be combined, or may be split into finer levels of granularity. The threshold values and/or predetermined ranges may be modified from those described above. For example the threshold spin value in step 210 may be 400 RPM, 350 RPM, 450 RPM, or any other desired value, based on a determination of a threshold below which vibration does not substantially inhibit machine function. In addition, the predetermined ranges may be plus or minus 50 RPM, plus or minus 75 RPM, plus or minus 100 RPM, or any other desired range, or even a range that is plus and minus different values, e.g., plus 75 RPM and minus 50 RPM. Any calculable range may be used. Variable names are representative only, and alternative names may be used instead, provided that the alternative variables represent the same function or meaning.

For example, the above described method automatically changes the prospective new harmonic speed NVS when the max vibration speed VS is not within a predetermined range of NVS. However, a shift in VS for a single cycle may be an anomaly or the result of external input, e.g., a laundry basket or box of detergent is sitting on top of the laundry appliance, thereby changing the vibration characteristics of the appliance. Thus, in an alternative embodiment, the above described method may incorporate a second counter that tracks how many times the a maximum vibration speed VS has been consecutively detected (within a predefined range, similar as above), and only changes NVS after the maximum vibration speed VS has been consecutively detected a predetermined number of times, e.g., twice in a row, three times in a row, etc. Adjustments to the method may include, if the new vibration speed NVS is not within range of the previously known new vibration speed NVS and is still outside the range of the harmonic speed HS then the change counter may be incremented, a second (new) counter is incremented and the second possible new vibration speed is saved for future reference. If this second new vibration speed persists for a predetermined number of cycles then the second new vibration speed replaces the first new vibration speed. If the second new vibration speed does not persist or if the second new vibration speed replaces the first new vibration speed, then the second counter and second new vibration speed are cleared. The change counter CC may or may not be reset when the new vibration speed NVS is changed according to this paragraph.

Figure 3:
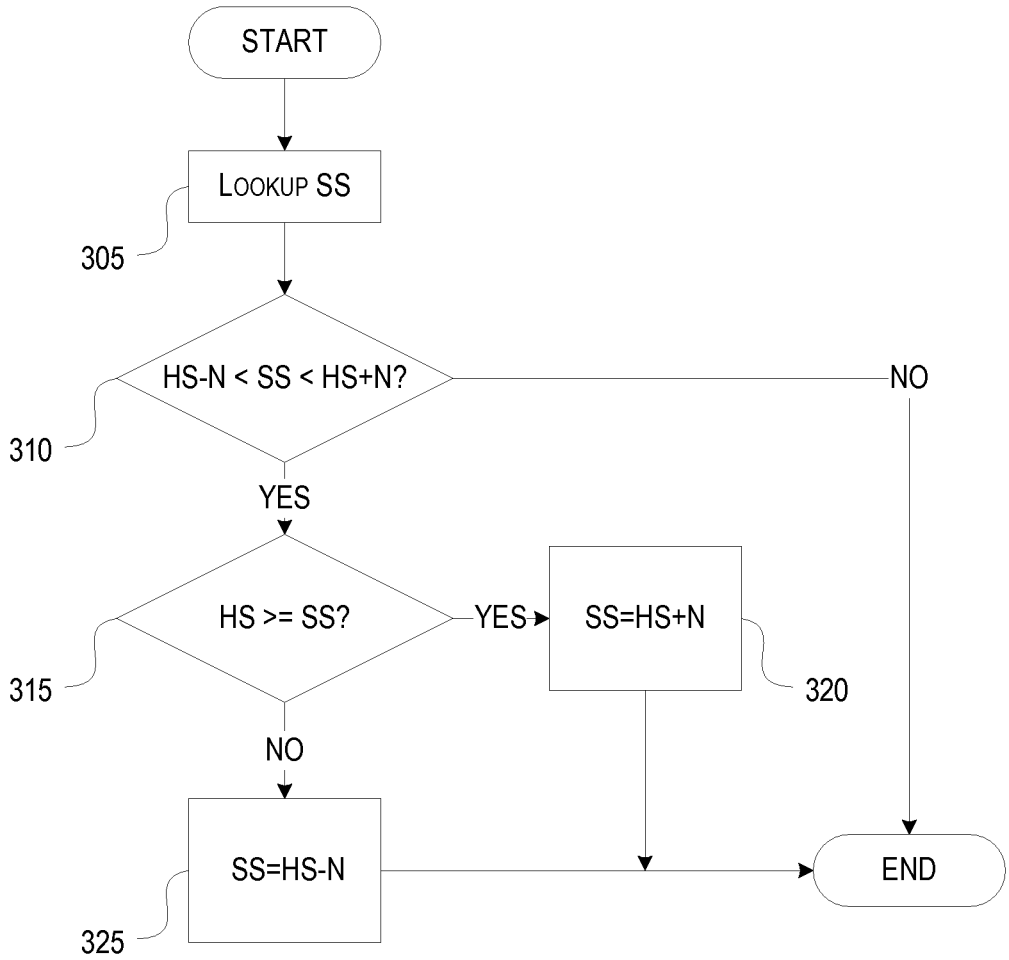
FIG. 3 illustrates a method for avoiding a previously detected high vibration level, according to one or more illustrative aspects of the invention.

FIG. 3 illustrates a method for avoiding a maximum vibration speed, or harmonic speed, according to one or more aspects of the invention. Initially, in step 305, washing machine 101 looks up or otherwise determined a desired spin speed SS. Washing machine 101 may determine the spin speed based on one or more cycle variables for the current load of laundry or other items in the appliance. Cycle variables (e.g., load size, type, etc.) may be received as user input via the control panel 103, or may be detected or determined automatically by one or more sensors or algorithms in or used by washing machine 101.

In step 310 washing machine 101 determines wither the desired spin speed is within a harmonic band defined by the known harmonic speed of the washing machine (if no harmonic speed HS has yet been set, then steps 310-325 may be skipped). The harmonic band may be defined by the harmonic speed HS plus or minus a predetermined range, e.g., HS plus or minus 75 RPM. Other values and ranges may be used, as described above with respect to FIG. 2.

If the spin speed SS is not within the harmonic band, then the method of FIG. 3 ends and returns the spin speed SS to the washing machine for use in the spin cycle. However, if the spin speed is within the harmonic band, then in steps 315-325 the washing machine 101 adjusts the spin speed to be outside the upper or lower boundary of the harmonic zone depending on whether the original spin speed was higher or lower than the known harmonic speed. If the originally intended spin speed is higher than the harmonic speed as determined in step 315, but is still within the harmonic band as determined by step 310, then washing machine 101 adjusts the spin speed SS in step 320 to be outside the upper boundary of the harmonic zone (unless the upper boundary is beyond the maximum spin speed available to a given model, in which case the spin speed is adjusted to the maximum allowable spin speed for that model). Similarly, if the originally intended spin speed is lower than the harmonic speed as determined in step 315, but is still within the harmonic band as determined by step 310, then washing machine 101 adjusts the spin speed SS in step 325 to be outside the lower boundary of the harmonic zone. The routine then ends and returns the adjusted spin speed to the washing machine for use during the spin cycle.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for avoiding maximum vibration in a laundering device, comprising:

identifying a first harmonic speed at which vibration is at a maximum during a first spin cycle of the laundering device;

setting a current harmonic speed parameter to be equal to the first harmonic speed;

identifying a spin speed for a second spin cycle of the laundering device;

when the spin speed is within a predefined range of the current harmonic speed parameter, adjusting the spin speed to be outside the predefined range of the current harmonic speed parameter during the second spin cycle;

completing the second spin cycle based on the adjusted spin speed;

determining that a second harmonic speed at which vibration is at a maximum during a spin cycle subsequent to the first spin cycle is different from said current harmonic speed parameter; and adjusting the current harmonic speed parameter to be equal to the second harmonic speed when it is detected, during each of a plurality of consecutive spin cycles after the subsequent spin cycle, that a speed at which vibration is at a maximum is within a predetermined range of the second harmonic speed.

2. The method of claim 1, wherein identifying the first harmonic speed comprises:

periodically reading a vibration level detected by a vibration sensor when the laundering device is spinning a drum above a predefined threshold speed;

when the read vibration level is higher than all previously read vibration levels, storing the read vibration level and a speed associated with the read vibration level; and saving the speed associated with the last stored read vibration level as the first harmonic speed.

3. The method of claim 2, wherein the predefined threshold speed is 400 revolutions per minute (RPM).

4. The method of claim 1, wherein the predefined range is defined by the equation: current harmonic speed parameter−(harmonic band/2)<current harmonic speed parameter<current harmonic speed parameter+(harmonic band/2), wherein the harmonic band is defined as the current harmonic speed parameter plus or minus a predetermined amount.

5. The method of claim 4, wherein the predefined amount is 75 revolutions per minute (RPM) such that the harmonic band is 150 RPM.

6. The method of claim 1, wherein adjusting the spin speed comprises:

when the spin speed is greater than the current harmonic speed parameter, adjusting the spin speed to be above the upper end of the predefined range; and when the spin speed is less than the current harmonic speed parameter, adjusting the spin speed to be below the lower end of the predefined range.

7. A laundering appliance, comprising:

a processor controlling one or more operations of the appliance; and memory storing computer readable instructions that, when executed by the processor, configure the appliance to:

identify a first harmonic speed at which vibration is at a maximum during a first spin cycle of the laundering appliance;

set a current harmonic speed parameter to be equal to the first harmonic speed;

identify a spin speed for a second spin cycle of the laundering device;

when the spin speed is within a predefined range of the current harmonic speed parameter, adjust the spin speed to be outside the predefined range of the current harmonic speed parameter during the second spin cycle;

complete the second spin cycle based on the adjusted spin speed; and determine that a second harmonic speed at which vibration is at a maximum during a spin cycle subsequent to the first spin cycle is different from said current harmonic speed parameter;

adjust the current harmonic speed parameter to be equal to the second harmonic speed when it is detected, during each of a plurality of consecutive spin cycles after the subsequent spin cycle, that a speed at which vibration is at a maximum is within a predetermined range of the second harmonic speed.

8. The laundering appliance of claim 7, wherein the laundering appliance is configured to identify the first harmonic speed by:

periodically reading a vibration level detected by a vibration sensor when the laundering device is spinning a drum above a predefined threshold speed;

when the read vibration level is higher than all previously read vibration levels, storing the read vibration level and a speed associated with the read vibration level; and saving the speed associated with the last stored read vibration level as the first harmonic speed.

9. The laundering appliance of claim 8, wherein the predefined threshold speed is 400 revolutions per minute (RPM).

10. The laundering speed appliance of claim 7, wherein the predefined range is defined by the equation: current harmonic parameter−(harmonic band/2)<current harmonic speed parameter<current harmonic speed parameter+(harmonic band/2), wherein the harmonic band is defined as the current harmonic speed parameter plus or minus a predetermined amount.

11. The laundering appliance of claim 10, wherein the predefined amount is 75 revolutions per minute (RPM) such that the harmonic band is 150 RPM.

12. A laundering appliance, comprising:

a processor controlling one or more operations of the appliance; and memory storing computer readable instructions that, when executed by the processor, configure the appliance to:

identify a first harmonic speed at which vibration is at a maximum during a first spin cycle of the laundering appliance;

set a current harmonic speed parameter to be equal to the first harmonic speed;

identify a spin speed for a second spin cycle of the laundering device;

when the spin speed is within a predefined range of the current harmonic speed parameter, adjust the spin speed to be outside the predefined range of the current harmonic speed parameter during the second spin cycle, wherein the laundering appliance is configured to adjust the spin speed by:

when the spin speed is greater than the current harmonic speed parameter, adjusting the spin speed to be above the upper end of the predefined range or to be a maximum spin speed for the appliance, whichever is lower, and when the spin speed is less than the current harmonic speed parameter, adjusting the spin speed to be below the lower end of the predefined range;

complete the first subsequent spin cycle based on the adjusted spin speed; and determining that a second harmonic speed at which a vibration is at a maximum during a spin cycle subsequent to the first spin cycle is different from said current harmonic speed parameter;

adjusting the current harmonic speed parameter to be equal to the second harmonic speed when it is detected, during each of a plurality of consecutive spin cycles after the second subsequent spin cycle, that a speed at which vibration is at a maximum is within a predetermined range of the second harmonic speed.

13. The laundering appliance of claim 12, wherein the laundering appliance is configured to identify the first harmonic speed by:

periodically reading a vibration level detected by a vibration sensor when the laundering device is spinning a drum above a predefined threshold speed;

when the read vibration level is higher than all previously read vibration levels, storing the read vibration level and a speed associated with the read vibration level; and saving the speed associated with the last stored read vibration level as the first harmonic speed.

14. The laundering appliance of claim 13, wherein the predefined threshold speed is 400 revolutions per minute (RPM).

15. The laundering appliance of claim 12, wherein the predefined range is defined by the equation: current harmonic speed parameter−(harmonic band/2)<current harmonic speed parameter<current harmonic speed parameter+(harmonic band/2), wherein the harmonic band is defined as the current harmonic speed parameter plus or minus a predetermined amount.

16. The laundering appliance of claim 15, wherein the predefined amount is 75 revolutions per minute (RPM) such that the harmonic band is 150 RPM.

17. The method of claim 1, wherein the predetermined range is within 50 RPM.

* * * * *